US008882643B1

(12) United States Patent
Calkins

(10) Patent No.: US 8,882,643 B1
(45) Date of Patent: Nov. 11, 2014

(54) METHOD AND SYSTEM FOR FUNCTIONAL TRAINING

(71) Applicant: Mary S. Calkins, Wimberley, TX (US)

(72) Inventor: Mary S. Calkins, Wimberley, TX (US)

( * ) Notice: Subject to any disclaimer, the term of this patent is extended or adjusted under 35 U.S.C. 154(b) by 0 days.

(21) Appl. No.: 14/329,005

(22) Filed: Jul. 11, 2014

Related U.S. Application Data

(60) Provisional application No. 61/917,084, filed on Dec. 17, 2013.

(51) Int. Cl.

| | |
|---|---|
| ***A63B 21/072*** | (2006.01) |
| ***A63B 47/00*** | (2006.01) |
| ***A63B 26/00*** | (2006.01) |
| ***A63B 43/02*** | (2006.01) |

(52) U.S. Cl.
CPC ..... *A63B 26/00* (2013.01); *A63B 43/02* (2013.01)
USPC ..... 482/108; 482/92; 482/93; 206/315.91

(58) Field of Classification Search
USPC ..... 482/148, 142, 92–93; 717/100; 473/505, 510; 2/19
See application file for complete search history.

(56) References Cited

U.S. PATENT DOCUMENTS

| | | | | |
|---|---|---|---|---|
| 4,502,690 | A * | 3/1985 | Ruperto | 473/513 |
| 4,511,148 | A * | 4/1985 | Amos et al. | 473/465 |
| 4,595,205 | A * | 6/1986 | Ruperto | 473/513 |
| 4,742,620 | A * | 5/1988 | Manker | 33/510 |
| 5,290,039 | A * | 3/1994 | Cornelio | 473/513 |
| 6,257,990 | B1 * | 7/2001 | Kariatsumari | 473/286 |
| 7,648,433 | B1 * | 1/2010 | Huqueriza | 473/510 |
| 8,100,757 | B2 * | 1/2012 | Melendez | 463/23 |
| 8,170,807 | B2 * | 5/2012 | Barnett et al. | 702/19 |
| 8,446,275 | B2 * | 5/2013 | Utter, II | 340/539.12 |
| 8,640,289 | B2 * | 2/2014 | Reeder, Jr. | 5/640 |
| 2008/0171921 | A1 * | 7/2008 | Teller et al. | 600/301 |
| 2013/0211300 | A1 * | 8/2013 | Verkade et al. | 602/16 |
| 2014/0088996 | A1 * | 3/2014 | Damani | 705/2 |
| 2014/0125493 | A1 * | 5/2014 | Utter, II | 340/870.02 |
| 2014/0206955 | A1 * | 7/2014 | Stivoric et al. | 600/301 |

* cited by examiner

*Primary Examiner* — Stephen Crow
(74) *Attorney, Agent, or Firm* — Matthew E. Burr

(57) ABSTRACT

An exercise system provides a bed component having a frame portion and a liner portion disposed in the frame portion. The frame is formed to provide a pair of upwardly extended opposed wings. A ball component is sized to fit between the upwardly extended opposed wings of the bed frame portion and selectively removable therefrom, so that the bed component and the ball component are selectively utilized independently for exercise or combined into a unified exercise apparatus. The exercise system further provides a plurality of recommended exercise regimens for utilizing the bed component and the ball component, separately or in combination, for exercise. Each one of the plurality of recommended exercise regimens is assigned a unique color code. The plurality of recommended exercise regimens is available to a user on a subscription basis.

1 Claim, 6 Drawing Sheets

METHOD AND SYSTEM FOR FUNCTIONAL TRAINING

CROSS REFERENCE TO RELATED APPLICATIONS

This application relates to, claims the benefit of and priority from U.S. provisional patent application Ser. No. 61/917,084, of the same title, filed Dec. 17, 2013 by the same inventor, the disclosure of which is incorporated herein as if set forth in full.

TECHNICAL FIELD

This disclosure relates generally to exercise equipment and more particularly to a system of exercise pieces for Pilates, yoga, resistance and functional training exercise, and methods of use.

BACKGROUND

Exercising provides a myriad health benefits. However, exercising may be inconvenient if multiple separate types of equipment are needed. Too much inconvenience may dissuade a person from working out. Thus, any type of equipment which provides the user a convenient and effective way to exercise is beneficial.

SUMMARY

The present exercise system includes an apparatus that has a bed component and a ball component. The bed component has a frame portion and a liner portion disposed in the frame portion. The shape of the frame is formed to provide a pair of upwardly extended opposed wings at one end. The ball component is sized to fit between the upwardly extended opposed wings of the bed frame portion and is selectively removable from the bed portion. The bed component and the ball component are selectively utilized independently for exercise or combined into a unified exercise apparatus.

The system also includes goal-based nutrition and exercise regimen recommendations called "prescriptions" that use the bed component and the ball component, separately or in combination, for exercise. Each one of the prescribed exercise regimens is assigned a unique color code so that the prescriptions provide a plurality of color-coded exercise regimens.

The system also includes a nutrition aspect. The nutrition aspect of the system provides a point system in which each goal of the goal-based regimen is assigned a number of points so that a user can achieve a goal by accumulating the number of points indicated for the desired goal.

The exercise and nutrition prescriptions are available to a user on a subscription basis and may be available, for example, through a user account on a website.

The apparatus aspect of the present system, in a specific exemplary example, provides a bed component with a frame portion with a liner disposed in the frame. The frame portion has an integral handle at one end. The frame portion also has a perimeter with a plurality of holes disposed around it for attaching ancillary exercise equipment such as springs, straps and others resistance implements. The underside of the bed has a storage compartment and a finger grip insert at the end opposite from the handle end. The frame portion is shaped at the handle end to provide a pair of upwardly extended opposed wings.

The elastically deformable ball component of this exemplary embodiment has a handle. The ball is sized to fit between the upwardly extended opposed wings of the bed frame portion, and selectively removable from the bed frame, such that the ball component handle fits cooperatively above the bed component frame portion handle when properly positioned on the bed. The bed component and the ball component are selectively utilized independently for exercise or combined into a unified exercise apparatus.

BRIEF DESCRIPTION OF THE DRAWINGS

For a detailed description of exemplary embodiments, reference will now be made to the accompanying drawings in which.

NOTATION AND NOMENCLATURE

Certain terms are used throughout the following description and claims to refer to particular system components. As one skilled in the art will appreciate, different companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Various embodiments are directed to a system for exercising. In particular, a piece of workout apparatus is designed to enable a plurality of exercises; specifically, the exercise equipment enables a plurality of functional training exercises, Pilates-type exercises, and yoga-type exercises, although the apparatus is not limited solely to these types of exercises. The specification first turns to an overview of the workout apparatus 100.

Figure 1B:
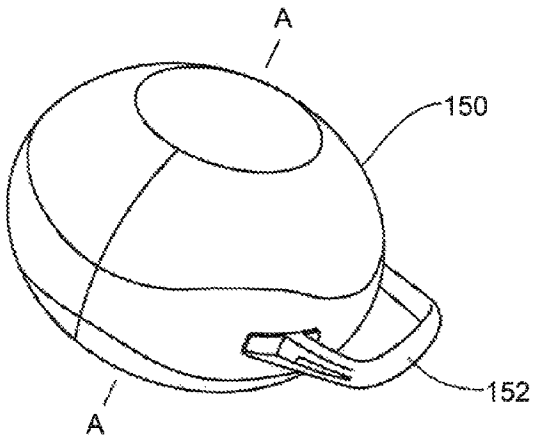
FIG. 1B is an oblique overhead view of a second component of a workout apparatus in accordance with at least some embodiments.
Figure 1A:
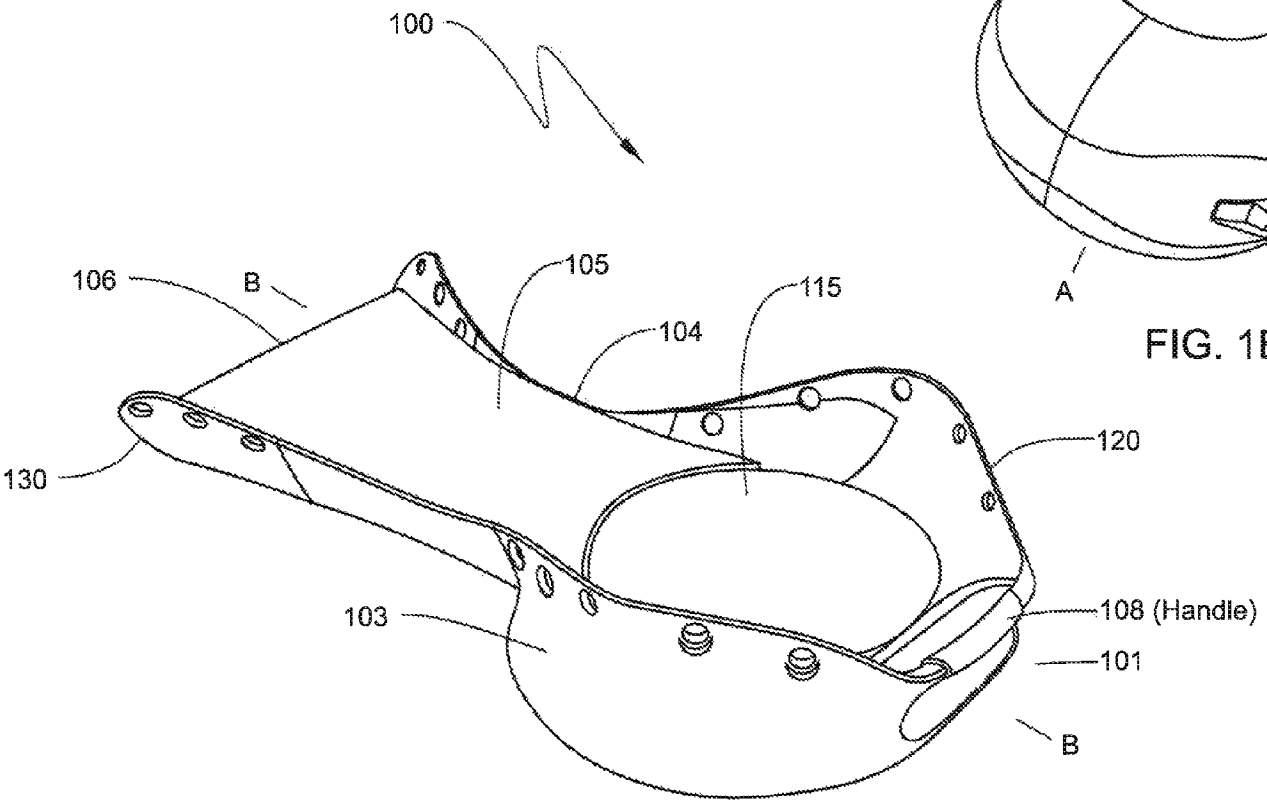
FIG. 1A is an oblique overhead view of a first component of a workout apparatus in accordance with at least some embodiments.

FIG. 1A shows an oblique overhead view of the exercise system 100 in accordance with some embodiments. In one embodiment, the system provides a first component designated a bed 101. One end of the bed 101 provides a curved recess portion 103 coupled to a tapered middle portion 104. At the end opposite the curved recess 102, connected in the middle by tapering portion 104, is an outwardly flaring portion 106, which gives the first component a slightly hourglass shape when seen from above. For convenience, tapering portion 106 is referred to as the foot, middle portion 104 as the body and recessed portion 103 as the head of first component 101 from time to time in this disclosure.

Bed 101 is formed with frame 103 and bed liners or cushions 105 and 115 seated in frame 103. Frame 103 is shaped, at the end for the recessed portion 102, with curved upward extensions, or "wings" 120. The wings 120 are preferably relatively stiff, so molded polyethylene plastic is a suitable and inexpensive material for manufacture. Exemplary embodiments provide one or more handles 108 which project outwardly from frame 103. Padded handles are preferred. Although FIG. 1 shows an illustrative one handle 108, any number of handles may be contemplated, so long as the number of handles does not impede use of the workout system 100.

At the opposite end, bed 101 has outwardly flaring portion 106, with smaller upwardly extending wings formed to accommodate the flared portion 106. As with wings 120, flared portion 106 is also relatively stiff and can be formed from mold plastic.

In contrast, the center portion of frame 103 between wings 120 and flared portion 106 provides a padded center wrap that is formed to follow the contours of wings 120 and flared portion 106.

Cushion 105 is shaped to accommodate and fit into the contours of frame 103 and preferably is manufactured with anti-microbial treated material. A composite material such as 80% vinyl, 15% polyester and 5% cotton is preferred. Circular cushion 115 is shaped to fit in wings 120 of frame 103 and to accommodate the second component of the present system.

System 100 further provides a second component shown in FIG. 1B, an exercise ball 150 that cooperatively fits into the recessed portion 102 of bed 101 and is also useful independently of the bed 101. Ball 150 is preferably not a perfect sphere, but rather is somewhat ovoid in shape and is elastically deformable with the application of force or weight upon it. The elastically deformable nature of the ball creates functional instability when weight is on it, which is beneficial for exercise effectiveness. Additionally, ball 150 provides one or more handles 152.

In one embodiment, the length of the workout apparatus 100 may be approximately 38 inches. The workout apparatus 100 is not solely limited to a length of 38 inches and the length may vary. The recessed portion 102 may have a diameter large enough that a user place both of the user's knees on the surface of the recessed portion 102 such that the user is in a kneeling position. For example, the recessed portion 102 may have a diameter of approximately 18 inches. Further still, the tapering portion 104 may have a width of ten inches, whereas the flared portion 106 may have a width of approximately 16.5 inches. It will be understood that these dimension are only illustrative and not intended to limit the scope of the invention.

The workout apparatus 100 ball 150 may weigh between 12 to 35 pounds. The weight of bed 101 alone may be approximately 20 pounds. However, the weight of the workout apparatus components is not limited to these amounts, and preferably is light enough to enable the user to lift the workout apparatus and perform training movements, while being heavy enough to provide a workout challenge.

Figure 2:
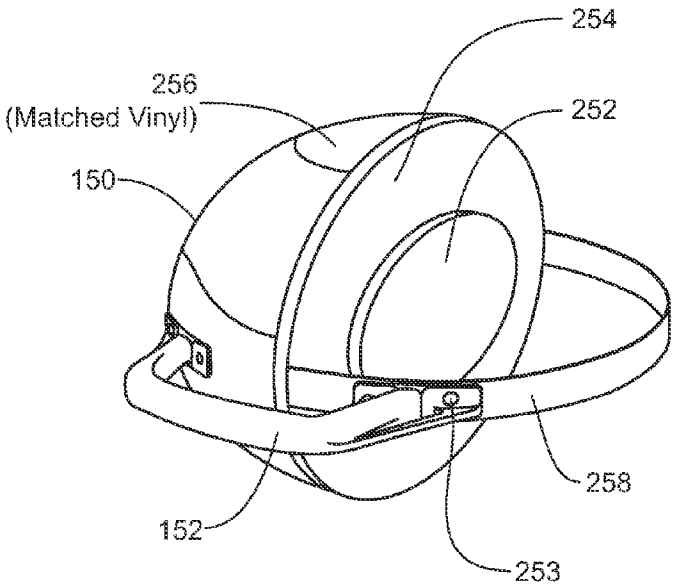
FIG. 2 is a cross-sectional side elevation view of the of the second component of FIG. 1B along line A-A.

FIG. 2 is a side view cross section taken along line A-A (see FIG. 1B) of ball 150. Core 252 may be filled with conventional materials such as open or closed cell foam rubber, but is preferably filled with ecologically friendly material such as shredded rubber from a rubber recycling source, vacuum packed rice or vacuum packed sand, for example. Outer layer 254 is preferably softer than core 252 but still dense enough to support the weight of a user. Preferred materials for outer layer 254 are selected from buckwheat seeds, kapok silk or other natural fiber, but more conventional materials such as memory foam are also suitable. Surface layer cover 256 houses core 252 and outer layer 254 and is preferably made from vinyl or other comfortable and easily cleanable material, but can be made from any suitable cover material, and cover 256 can be emblazoned with promotional information such as branding elements and trademarks.

Between outer layer 254 and cover 256, support band 258 is annularly disposed. Band 258 provides a substrate for the attachment of handle 152, and is preferably formed from a material such as plastic suitable for driving attachment screws into.

Handle 152 is coupled to ball 150 by way of a bolt system 253. Each handle end is coupled to a carabiner in which the carabiner is coupled through the fabric of the handle and into the workout apparatus 100.

In a preferred exemplary embodiment, bed 101 provides at least one handle 108. Alternative exemplary embodiments (not shown) provide additional handles attached to the workout apparatus 100 in variety of different locations in order to enable a plurality of different exercises. Handles may be located at a variety of different locations, and may be of any quantity so long as the handles do not interfere with the use of the apparatus.

In one alternative embodiment, the user can attach an elastic resistance member such as a spring (not shown) to workout apparatus 100 and use the resistance in a fashion similar to that of a dumbbell. For example, a resistance member attached workout apparatus 100 could be used for bicep curls or deadlifts.

Ball 150 provides handle 152, which is grippable such that the user could use the apparatus in a fashion similar to that of a kettlebell. In yet another embodiment, the handles may be used for leverage or resistance while the user is kneeling on, reclining on, or otherwise making use of the workout apparatus 100.

The workout apparatus 100 may also comprise at least one metal loop (not shown) into which a spring system may be coupled. In one embodiment, the loops are made of metal; however, the loops may be made of any material strong enough to provide resistance to the spring structure.

Figure 3:
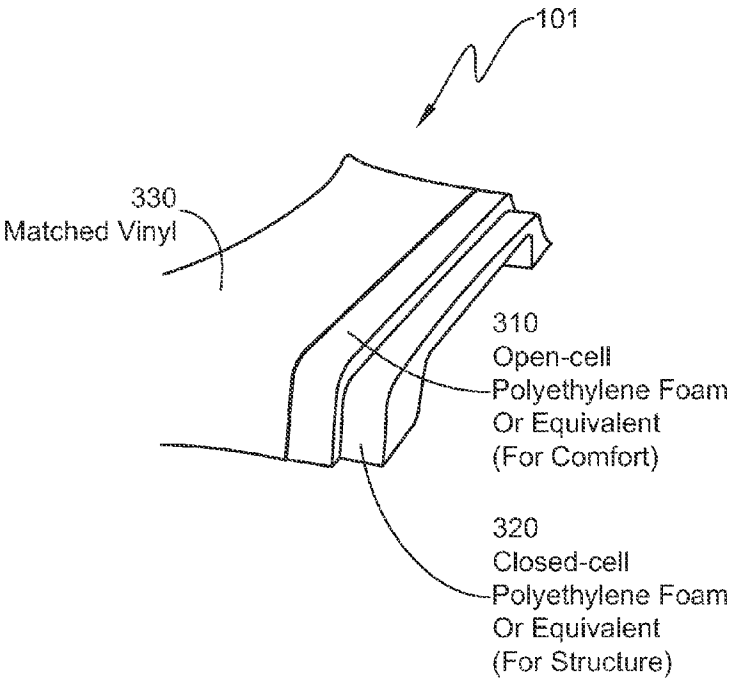
FIG. 3 is a cross-sectional elevation view of first component of FIG. 1B along line B-B.

FIG. 3 is a cut-away elevated view of a portion of bed 101 to illustrate the internal structure of bed 101. Base layer 320 provides a relatively stiff and stable structure to support the weight of a human body. A suitable material for base 320 is closed cell polyethylene foam, for example. Middle layer 310 provides cushioning for comfort, so open cell polyethylene foam is preferred. Outer layer 330 provides a durable and cleanable protective layer such as may be provided by vinyl. Outer layer 330 is a suitable substrate for printed information such as trademarks or exercise instructions.

Figure 4:
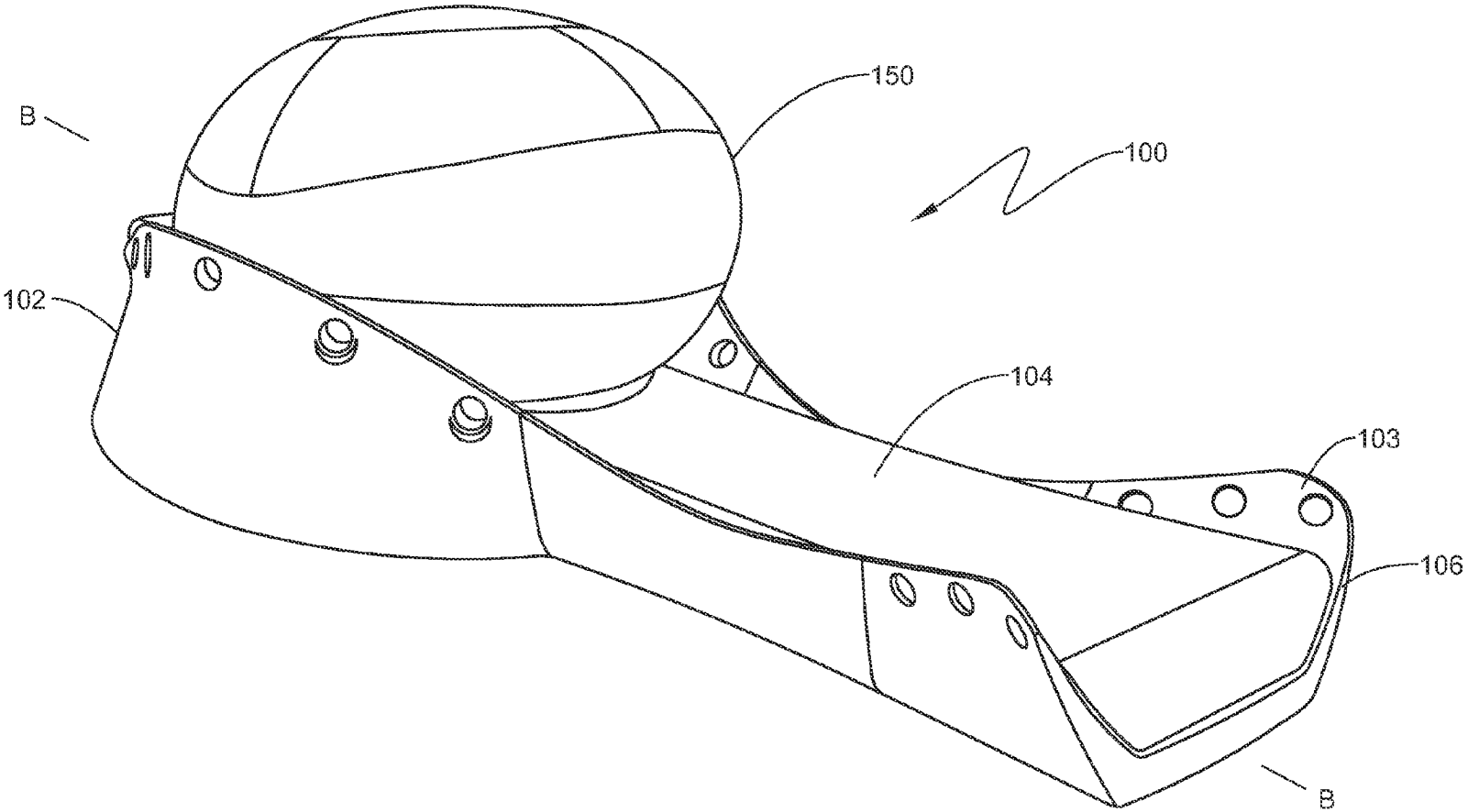
FIG. 4 is a front oblique view diagrammatic illustration of the exercise system of FIGS. 1A/1B.

FIG. 4 is a front oblique view diagrammatic illustration of the exercise system of FIGS. 1A/1B. Ball 150 is disposed within recessed portion 102. Frame 103 provides a plurality of perforations disposed around the flared portions of frame 103 and sized to accommodate a variety of exercise equipment accessories such as carabiners, springs, resistance bands, straps, handles and so forth, for example.

Figure 5:
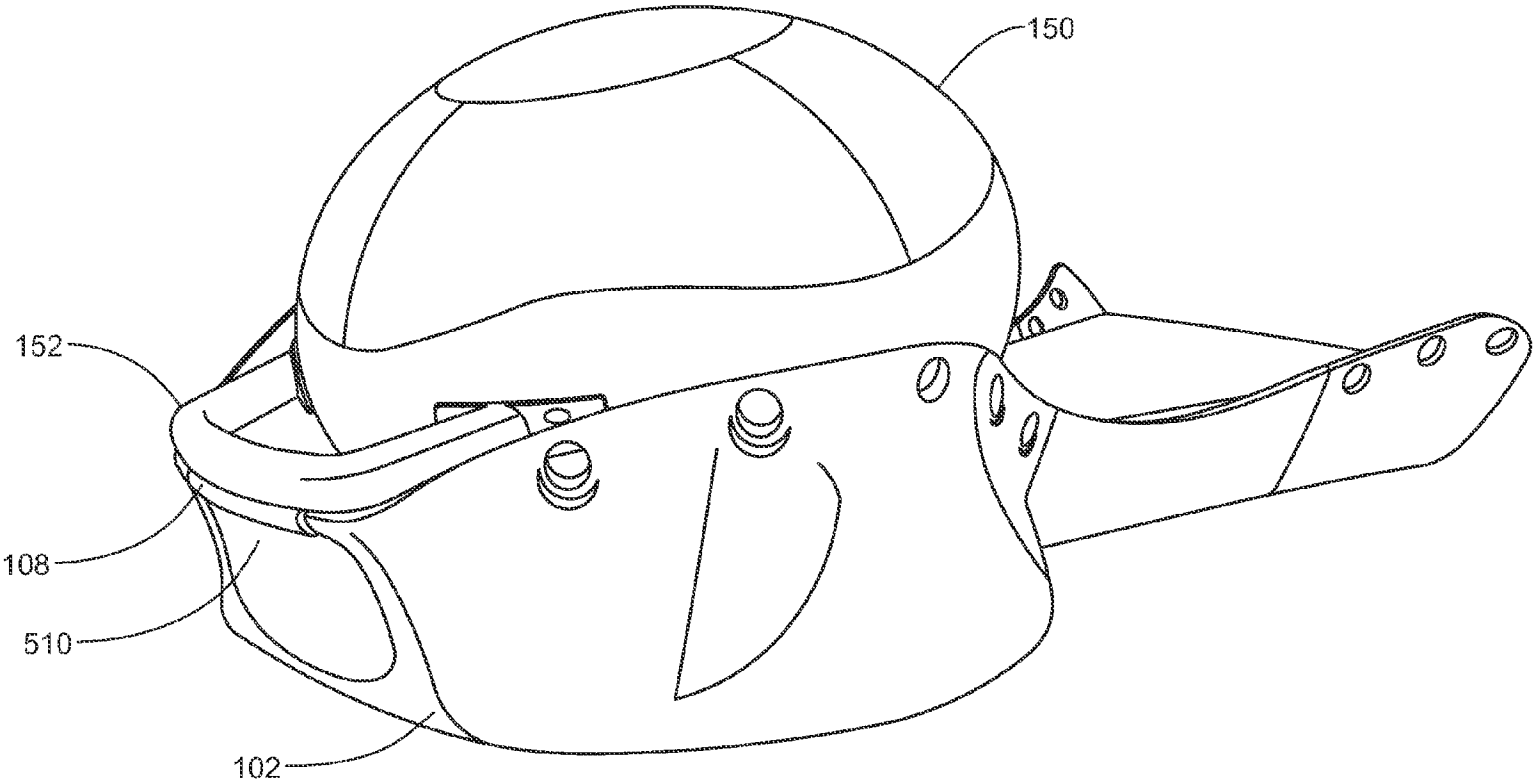
FIG. 5 is a back oblique view diagrammatic illustration of the exercise system of FIG. 4.

FIG. 5 is a back oblique view diagrammatic illustration of the exercise system of FIG. 4. Bed handle 108 is visible in this view and ball handle 152 is visible and shown to conform to the shape of frame portion 102 so that frame handle 108 and ball handle 152 cooperatively fit together. Below frame handle 108 an opening 510 is provided in frame portion 102 so that a user's hand can wrap around handle 108 unimpeded by the frame. Handle 108 is preferably integral to bed 101. Alternative embodiments provide on or more handles securely attached to the workout apparatus 100 by way of a bolt system, which is the case with ball 150 handle 152.

Figure 6:
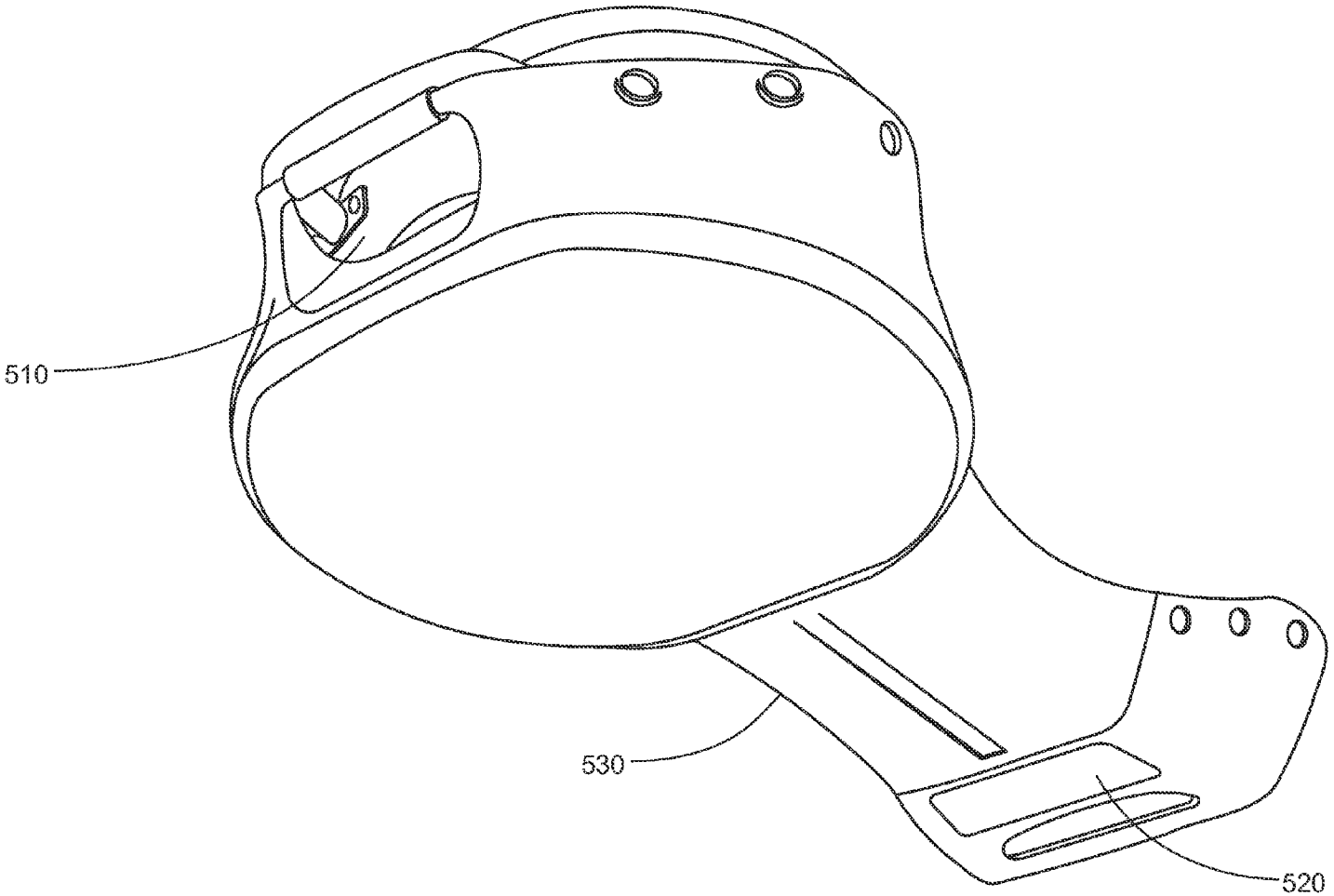
FIG. 6 is a bottom oblique view diagrammatic illustration of the exercise system of FIG. 4.

FIG. 6 is a bottom oblique view diagrammatic illustration of the exercise system of FIG. 4. This perspective provides a better view of opening 510. Additionally, closure 530 in the fabric enclosing portion 104 provides access to a hidden storage compartment. Insert 520 provides a finger grip for grabbing frame 101 at flared end 106.

Figure 7:
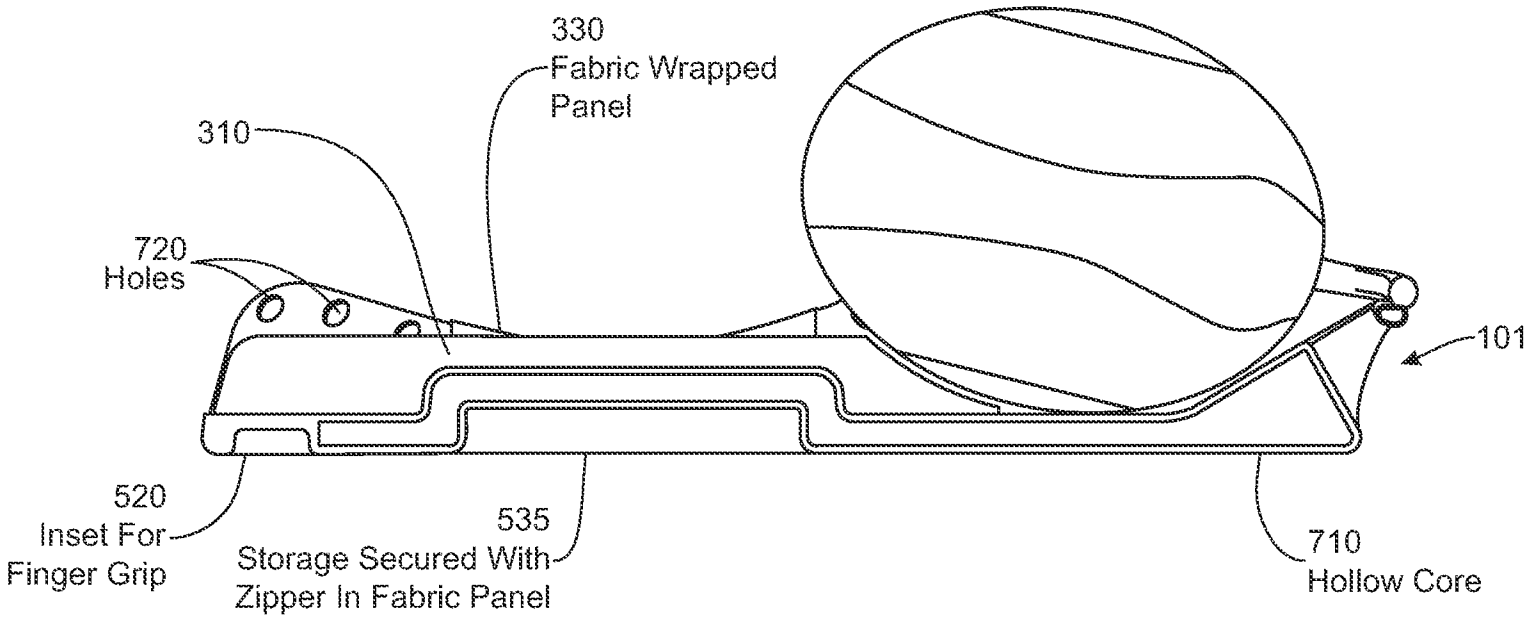
FIG. 7 is a side cross-sectional view of system 100 taken along line B-B of FIG. 4.

FIG. 7 is a side cross-sectional view of system 100 taken along line B-B of FIG. 4. Frame 101 is revealed to have a hollow core 710 formed from the material of frame 101, which material is shaped to provide storage compartment 535 and finger insert 520. Molded cushion 310 is wrapped in fabric such as nylon or other suitable synthetic or natural fiber.

The outermost layer of bed 105 is comprised of a durable material which covers and contains the inside elements of the workout apparatus 100. For example, the outermost layer 330 may be comprised of a flexible vinyl material. The vinyl material is of a thickness sufficient to withstand wear-and-tear during the use of the workout apparatus, but is still a thin covering layer (e.g., the thickness of layer 330 may be on the order of 5 millimeters).

Underneath and abutting the outermost layer 330 is a pliable material layer 310. In particular, layer 310 may be a pressure-sensitive foam layer which deforms and/or molds to some degree of the shape of whatever object is pressing into the foam layer (e.g., the user's knees, the floor). The density of the foam is sufficient to mostly hold the original, undeformed shape of the workout apparatus 100, but is soft enough to provide at least a partially flat surface on the bottom of bed 105 when the workout apparatus is placed on the floor.

Under the outermost layer 330, the tapered portion 104 and flared portion 106 are comprised of foam layer 310. Again, when placed on the floor, the tapered portion 104 and flared portion 106 may deform slightly to provide a flat surface, but otherwise the portions 104 and 106 maintain the original shape.

Within ball 150, nested inside the inner foam layer 254 is a weighted core 252. The weighted core 252 may be comprised of a material having more resistance to gradual deformation than the foam layer 254. For example, the core may be comprised of a quantity of sand grains, or a highly viscous and dense gel. When placed on the floor (or when placed against another surface), the layer 254 and core 252 have enough give to provide at least some stability of movement, but not so much stability that the base of the ball deforms completely to a flat surface. In other words, there remains some degree of curvature within the ball 150 regardless of whether the workout apparatus 100 is placed on the floor, pushed against another surface, and/or depressed by a portion of the user's body (i.e., hands, feet, knees, forearms, back).

The rounded cross-section of the ball 150 when placed against a surface enables the user to exercise on a partially unstable surface, while still providing some stability in the flattened (e.g., deformed) portion. An unstable exercise surface is advantageous for eliciting a great variety of muscle responses to resist the instability.

The workout apparatus also comprises an attachment system into which a carabiner or other attachment device may couple. A plurality of holes 720 distributed around the perimeter of bad 101 facilitates the attachment of ancillary exercise equipment. Apparatus 100 may further accommodate a plurality of springs. One end of the spring terminates in or is coupled to a clip system, such as a carabiner or other loop or fastener. The carabiner may be a metal loop comprising a spring loaded gate. The carabiner is attached to a metal loop (not shown), where the metal loop is coupled to the workout apparatus 100 via one of the holes 720, for example. In one exemplary embodiment, the metal loop may couple to the workout apparatus in a fashion similar to the handle 108, although any coupling mechanism may be used.

The opposite end of the spring is coupled to another handle, a fixed point or is grasped by the user. The user is able to grasp the free end of the spring and manipulate the spring in conjunction with use of the workout apparatus 100. For example, the springs may have varying spring constants, each of which provides some amount of resistance when a user stretches the spring, thus activating the use of a variety of muscles. The springs may be attached by the user in a variety of different quantities and positions in order to provide a variety of different exercises.

In one embodiment, the springs may be uncovered; in other words, the coils of the spring may be seen in full by the user. In another embodiment, the springs may be sheathed within a covering. The covering may be comprised of any of a variety of materials, such as a canvas cloth, a rubber material, a flexible plastic, or other material.

When not in use, the springs may be stored in a storage compartment (see FIG. 7) located on the underside of the tapered portion 104 and flared portion 106 of the workout apparatus. In one embodiment, the storage compartment may close by way of overlapping pieces of material. In another embodiment, the storage compartment may be closed by way of a zipper. In yet another embodiment, the storage compartment may be closed by way of snaps or buttons, hook and loop, or any other fastening mechanism.

In addition to the apparatus described above, the present system includes methods of using the apparatus by providing exercise and nutrition regimes. A point system is provided for a nutritional component. Exercise recommendations called "prescriptions" are a combination of the nutritional component and also specific recommendations for color-coded workouts for different goals. The exercise regime prescriptions include exercise videos for the apparatus. The prescriptions are made available to users by subscription either by a physical medium or electronically such as via a user account on a website.

The regimes are broken down into six color-coded categories:

Cardio intervals (red);
Pilates training (yellow);
Yoga training (green);
Functional training (blue); and
Medicine bell training (purple)
and "on-the-go" workouts for travel.

The workouts are typically in approximately 30 minute sessions, but two workouts are sometimes combined to provide for an hour workout, depending on the goal. An illustrative example of a "Prescription" is:

1. Goal: 20-30 lbs to lose:

Nutrition:

Reach 15,000 points a day on the nutrition program that corresponds to the goal (the nutrition program is designed so that one get points for healthy food, the more points, the better; one loses points for bad food, such as fast food or processed food).

Exercise:

Day 1: Red workout followed by yellow
Day 2: Red workout followed by green
Day 3: Blue workout
Day 4: Red workout
Day 5: Red workout followed by yellow
Day 6: Yellow workout
Day 7: Rest 2. Goal: 10 lbs or less to lose:

Reach 10,000 points a day on the nutrition program corresponding to the goal.

Exercise:

Day 1: Red workout
Day 2: Yellow workout
Day 3: Blue workout
Day 4: Rest
Day 5: Purple workout
Day 6: Red workout
Day 7: Rest References to "one embodiment," "an embodiment," "some embodiment," "various embodiments," or the like indicate that a particular element or characteristic is included in at least one embodiment of the invention. Although the phrases may appear in various places, the phrases do not necessarily refer to the same embodiment.

The above discussion is meant to be illustrative of the principals and various embodiments of the present invention. Numerous variations and modifications will become apparent to those skilled in the art once the above disclosure is fully appreciated. This discussion shall not be read as a limitation as to the scope of one or more of the embodiments described—the same techniques may be used for other embodiments. It is intended that the following claims be interpreted to embrace all such variations and modifications.

Many modifications and other embodiments of the exercise system described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercise system, the system comprising:

a. a bed component having a frame portion and a liner portion disposed in the frame portion, the frame portion having an integral handle at a first end, the frame portion also having a perimeter with a plurality of holes disposed therearound, the frame portion further having an underside comprising a storage compartment and a finger grip insert at a second end distal from the first end, the frame portion being formed at the first end to provide a pair of upwardly extended opposed wings;

b. an elastically deformable ball component having a handle wherein the ball is sized to fit between the upwardly extended opposed wings of the bed frame portion, and selectively removable therefrom, such that the ball component handle fits cooperatively above the bed component frame portion handle, whereby the bed component and the ball component are selectively utilized independently for exercise or combined into a unified exercise apparatus.

* * * * *